US009394867B2

(12) United States Patent
Schmid et al.

(10) Patent No.: US 9,394,867 B2
(45) Date of Patent: Jul. 19, 2016

(54) FUEL INJECTOR VALVE

(75) Inventors: Johannes Schmid, Immenstadt (DE); Juergen Graner, Sersheim (DE); Tilla Haubold, Dortmund (DE); Friedrich Moser, Magstadt (DE); Matthias Schumacher, Weissach (DE); Andreas Burghardt, Stuttgart (DE); Jochen Rager, Bisingen (DE)

(73) Assignee: Robert Bosch GmbH, Stuttgart (DE)

( * ) Notice: Subject to any disclaimer, the term of this patent is extended or adjusted under 35 U.S.C. 154(b) by 234 days.

(21) Appl. No.: 14/236,806

(22) PCT Filed: Jun. 6, 2012

(86) PCT No.: PCT/EP2012/060700
§ 371 (c)(1),
(2), (4) Date: Apr. 23, 2014

(87) PCT Pub. No.: WO2013/017320
PCT Pub. Date: Feb. 7, 2013

(65) Prior Publication Data

US 2014/0224902 A1 Aug. 14, 2014

(30) Foreign Application Priority Data

Aug. 3, 2011 (DE) ..... 10 2011 080 355

(51) Int. Cl.
*F02M 51/06* (2006.01)
*F02M 61/16* (2006.01)
(Continued)

(52) U.S. Cl.
CPC ..... *F02M 51/061* (2013.01); *B22F 5/106* (2013.01); *F02M 51/0614* (2013.01); *F02M 61/166* (2013.01); *F02M 61/168* (2013.01); *B22F 3/225* (2013.01); *C22C 33/0285* (2013.01); *F02M 2200/8046* (2013.01);
(Continued)

(58) Field of Classification Search
CPC . F02M 51/06; F02M 51/061; F02M 51/0614; F02M 51/0689; F02M 61/166; Y10T 29/4902; Y10T 29/49075
See application file for complete search history.

(56) References Cited

U.S. PATENT DOCUMENTS 5,687,468 A * 11/1997 Hans ..... F02M 51/0614 251/129.21
6,244,526 B1 * 6/2001 Schuldt ..... F02M 51/0671 239/585.1

(Continued)

FOREIGN PATENT DOCUMENTS

DE 33 00 437 5/1984
DE 10 2005 052252 5/2007

(Continued)

OTHER PUBLICATIONS

International Search Report for PCT/EP2013/060700, dated Oct. 11, 2012.

*Primary Examiner* — Ryan Reis
(74) *Attorney, Agent, or Firm* — Norton Rose Fulbright US LLP

(57) ABSTRACT

A fuel injection valve for injecting fuel includes: a coil, an internal pole, a valve sleeve, and a magnetic separating element, where the valve sleeve and the magnetic separating element are embodied in one piece as a powder injection-molded component, and the valve sleeve forms a magnetic region and the magnetic separating element forms a non-magnetic region, which are intermaterially joined to one another.

13 Claims, 5 Drawing Sheets

(51) Int. Cl.

| | |
|---|---|
| ***B22F 5/10*** | (2006.01) |
| *B22F 3/22* | (2006.01) |
| *C22C 33/02* | (2006.01) |
| *H01F 41/02* | (2006.01) |
| *H01F 3/10* | (2006.01) |
| *H01F 7/08* | (2006.01) |

(52) U.S. Cl.
CPC ... *F02M 2200/9053* (2013.01); *H01F 41/0246* (2013.01); *H01F 2003/106* (2013.01); *H01F 2007/085* (2013.01)

(56) References Cited

U.S. PATENT DOCUMENTS

| | | | | |
|---|---|---|---|---|
| 6,386,467 | B1 * | 5/2002 | Takeda | F02M 51/0617 239/585.1 |
| 6,834,667 | B2 * | 12/2004 | Sumiya | F02M 51/0671 137/15.18 |
| 8,833,678 | B2 * | 9/2014 | Reiter | F02M 51/0614 239/585.1 |
| 2008/0156906 | A1 * | 7/2008 | Cagnolati | F02M 51/0614 239/585.1 |

FOREIGN PATENT DOCUMENTS

| | | | |
|---|---|---|---|
| DE | 10 2009 008458 | | 8/2010 |
| GB | 2 145 016 | | 3/1985 |
| JP | 8284775 | A1 | 10/1996 |
| JP | 3504273 | | 11/1997 |
| JP | 200530336 | A1 | 2/2005 |
| JP | 2005 089777 | | 4/2005 |
| JP | 3895738 | A1 | 1/2006 |
| JP | 4211814 | A1 | 1/2008 |
| JP | 4104508 | | 6/2008 |
| JP | 2009127445 | A1 | 6/2009 |
| JP | 2010203375 | A1 | 9/2010 |
| WO | WO 2011/076535 | | 6/2011 |
| WO | WO 2012/019807 | | 2/2012 |

* cited by examiner

FUEL INJECTOR VALVE

BACKGROUND OF THE INVENTION

1. Field of the Invention

The present invention relates to a fuel injection valve for injecting fuel.

2. Description of the Related Art

High-pressure injection valves of the existing art as a rule have a high-performance magnetic circuit that enables the implementation of short switching times as well as reproducible opening and closing behavior. Although an internal pole has a high saturation induction in order to achieve high dynamics, with present-day high-pressure injection valves magnetic losses occur via their valve sleeve as the magnetic field builds up and decays. This results in an appreciable degradation of the switching time and dynamics of the fuel injection valve. In addition, production of the magnet armature is very cost-intensive and complex. Resistance to aggressive media, for example ethanol or urea, which are increasingly contained in fuels, is moreover insufficient to ensure satisfactory long-term durability of the injection valves even in countries having large fluctuations in fuel quality. In addition, conformity with regulatory requirements, in particular with regard to the use of materials hazardous to health, must be ensured for the future.

BRIEF SUMMARY OF THE INVENTION

The fuel injection valve according to the present invention has the advantage that in this context a magnetic separation is provided between the valve sleeve and the internal pole, which separation makes possible a considerable reduction in magnetic losses and thus an appreciably shortened switching time for the valve. In addition, thanks to the use of suitable materials, improved robustness and wear resistance are achieved with respect to aggressive media such as ethanol, etc. This is achieved according to the present invention in that the fuel injection valve encompasses a coil, an internal pole, a valve sleeve, and a magnetic separating element. The valve sleeve and the magnetic separating element are embodied in one piece as a powder injection-molded component, the valve sleeve forming a magnetic region and the magnetic separating element forming a non-magnetic region, which are intermaterially joined to one another. It is thus possible to use, for the valve sleeve, a fuel-resistant, high-pressure-resistant ferrite material having the lowest possible carbon proportion and preferably a chromium content from 13% to 17%. In addition, a non-magnetic austenite material can be used for the magnetic separating element, contributing to an appreciable reduction in magnetic losses. Production of a one-piece component as an intermaterial powder injection-molded component, in a single process step in time- and cost-optimized fashion as a mass-produced part, is furthermore made possible thereby in simple fashion.

A welded join or soldered join is preferably provided between the powder injection-molded component and the internal pole. An operationally reliable attachment, which can be manufactured efficiently in terms of time and cost in the context of production, is thus ensured.

Also preferably, the internal pole has a passthrough opening in an axial direction. The result is that passage of fuel through the internal pole is enabled, and the fuel injection valve can have a more compact structure.

Preferably, the internal pole is embodied as a powder injection-molded component and is manufactured from a material having a high magnetic saturation induction, in particular FeCo having a cobalt proportion from 17% to 50%. Particularly preferably, a material having a cobalt proportion from 48% to 50% can also be used, since this material also has the advantage of good fuel resistance.

According to a further preferred embodiment, the internal pole is embodied as a powder injection-molded component and encompasses a first region having a first magnetic saturation induction and a second region having a second magnetic saturation induction that is lower than the first magnetic saturation induction. The first and second regions are intermaterially joined to one another. The first region having the higher magnetic saturation induction, which is preferably manufactured from an FeSi material having a silicon proportion from 1% to 7%, or from an FeCo material having a cobalt proportion from 17% to 50%, ensures in this context the high dynamics with short switching times of the fuel injection valve. For the second region, the use of fuel-resistant, high-pressure-resistant ferrite having a low carbon proportion and a chromium content of 13% to 17% is thus also possible. Besides an appreciable cost reduction, sufficient robustness in terms of the fuel coming into contact therewith can thus be achieved.

The valve sleeve, the magnetic separating element, and the internal pole are preferably embodied in one piece as a powder injection-molded component, and are intermaterially joined to one another.

Additionally preferably, the valve sleeve and the internal pole are manufactured from a single material, in particular from X2Cr13MoSi. As a result, in addition to permanent fuel resistance for the powder injection-molded component, a reduction in the number of different materials is achieved, and production of the fuel injection valve is substantially simplified.

According to a further preferred embodiment, the second region of the internal pole is manufactured from a fuel-resistant magnet material that encases the internal pole as a fuel-resistant layer and ensures resistance to aggressive fuels. In addition, as a result of the magnetic separating element adjacent to the first region having a high magnetic saturation induction, reliable magnetic separation is achieved with respect to the valve sleeve adjacent thereto, so that magnetic losses are appreciably minimized by this one-piece component.

The second region preferably forms an enveloping region of the passthrough opening and an end-face region of the internal pole, the end-face region having, in particular, a thickness of 0.5 mm in the axial direction. Also preferably, the end-face region forms a stop for a magnet armature. The result is that a fuel-resistant end-face region, which at the same time makes possible a wear-resistant armature stop, is achieved in a residual air gap between the internal pole and magnet armature.

The first region of the internal pole preferably has a circumferential flange region projecting in a radial direction. An upper cover for the fuel injection valve can thus additionally be integrated into the one-piece powder injection-molded component, resulting in a further reduction in parts count.

According to a further preferred embodiment, the magnetic separating element is a circumferential ring. Also preferably, a fuel-resistant material is provided on an inner enveloping region of the annular magnetic separating element. Preferably all corrosion-resistant layers of the entire powder injection-molded component are manufactured from the same material, so that production thereof is substantially simplified.

Also preferably, the magnetic separating element is embodied as a magnetic choke that has a first and a second magnetic connection region, a choke region, and a first and a second transition region. The first and the second transition region are disposed in an axial direction between the first and the second connection region, and the choke region is disposed between the first and the second transition region. The preferably magnetic ferrite material in the choke region and in the first and second transition regions is filled with non-magnetic austenite material. As a result, in addition to a minimization of the magnetic leakage flux, a further reduction in the switching times of the fuel injection valve can also be achieved.

The first and the second transition region are preferably embodied in tapering fashion. The choke behavior can thereby be individually adapted depending on the application.

Also preferably, the choke region has an inner and/or outer cylindrical region made of a magnetic, electrically conductive material. The cylindrical region is embodied here as a thin ferritic layer. In order to increase strength, the choke region has an additional region made of non-magnetic austenite material or ceramic material. A preferred layer thickness of the cylindrical region in this context is at most 0.5 mm, in particular 0.2 to 0.3 mm, particularly preferably 0.25 mm. In addition, the choke effect can be individually adapted by varying the thickness of the magnetic cylindrical region.

According to a further preferred embodiment, the choke region is manufactured from an electrically non-conductive material. Thanks to the use of, for example, a ceramic material, an eddy-current loss can be reduced and the dynamics of the fuel injection valve can be further increased, and its switching times can be further reduced.

DETAILED DESCRIPTION OF THE INVENTION

Figure 1:
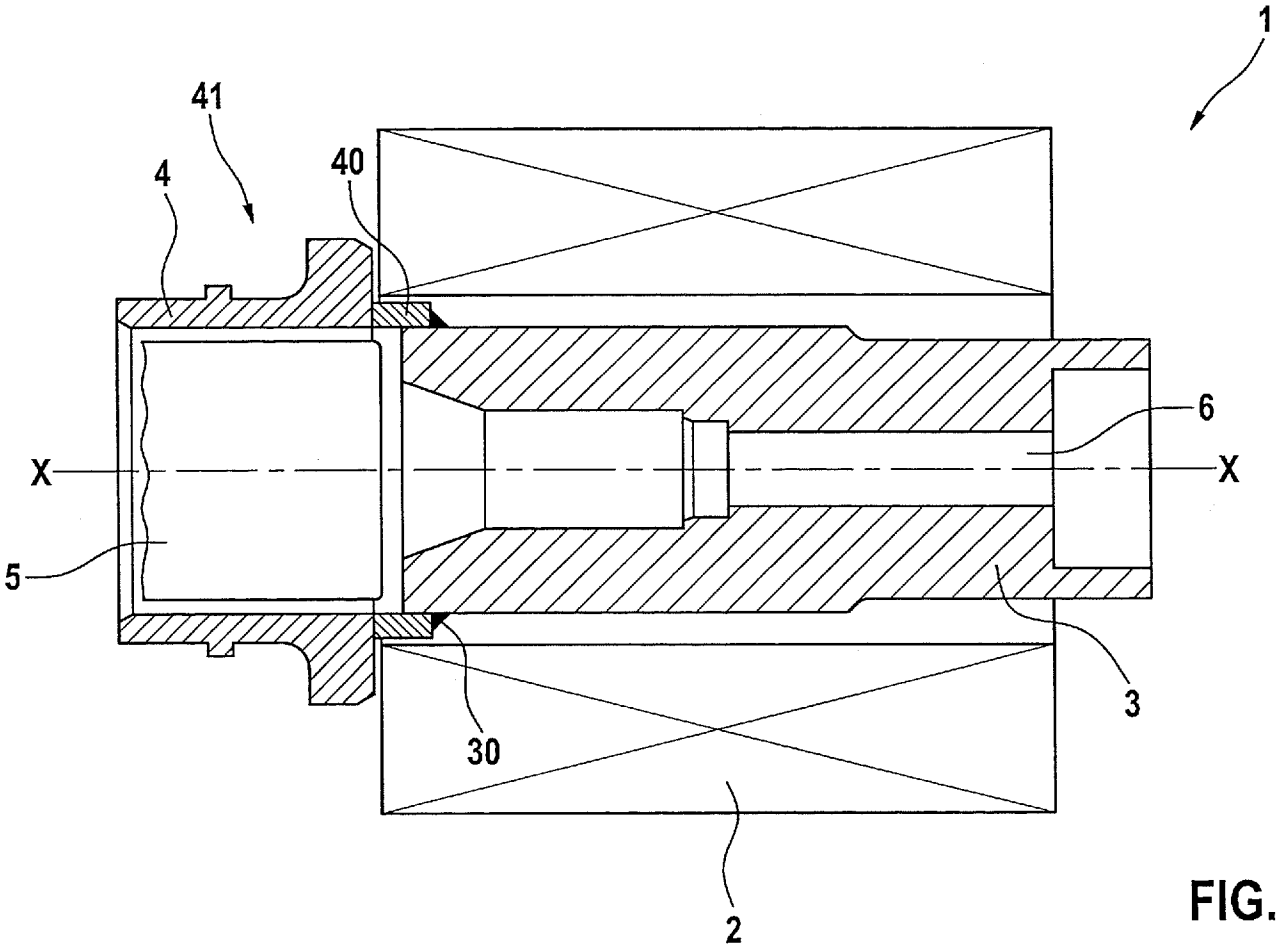
FIG. 1 is a schematic sectioned depiction of a part of a fuel injection valve, in accordance with a first embodiment of the invention.

Preferred exemplifying embodiments of a fuel injection valve 1 will be described in detail below with reference to FIGS. 1 to 7. Identical or functionally identical components are labeled in the exemplifying embodiments with the same reference characters.

Figure 2:
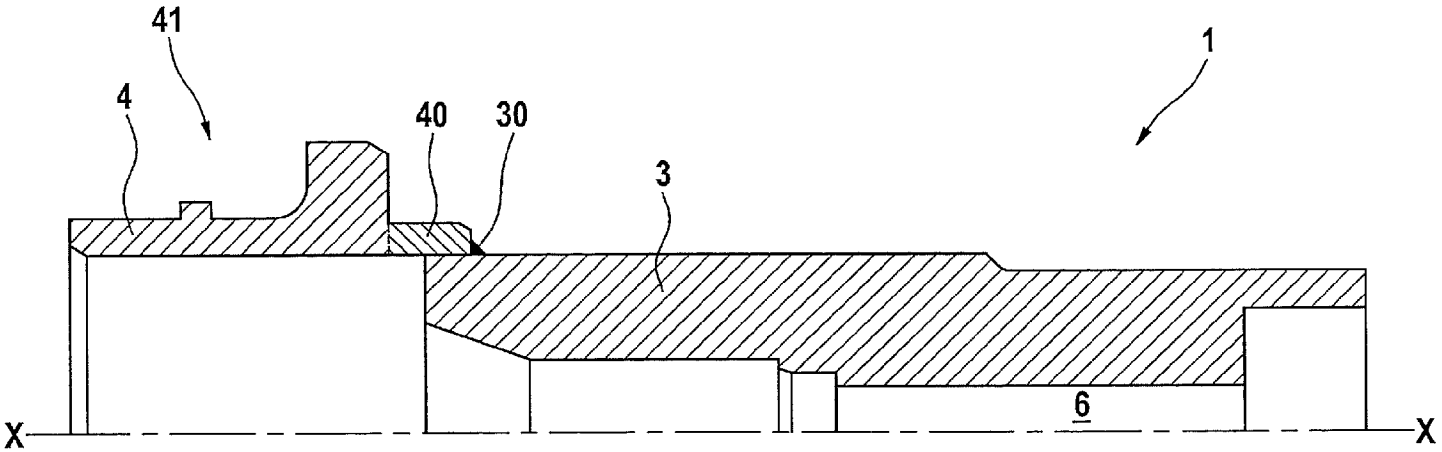
FIG. 2 is an enlarged partial sectioned depiction of FIG. 1.

FIG. 1 and FIG. 2 are sectioned views of a subregion of a fuel injection valve 1 in accordance with a first exemplifying embodiment of the invention, which encompasses a coil 2, an internal pole 3, a valve sleeve 4, a magnetic separating element 40, and a magnet armature 5. Magnetic separating element 40 is embodied here in annular cylindrical fashion, and is attached to internal pole 3 by way of a welded join 30. Instead of welded join 30, a soldered join can alternatively also be provided. Internal pole 3 has a centered passthrough opening 6 extending in an axial direction X-X.

As illustrated by the sectioned depiction of FIG. 2, valve sleeve 4 and magnetic separating element 40 of the first exemplifying embodiment are embodied here in one piece as a powder injection-molded component 41, and are intermaterially joined to one another. Valve sleeve 4 forms a magnetic region, and magnetic separating element 40 forms a non-magnetic region. Valve sleeve 4 is preferably manufactured from a fuel-resistant, high-pressure-resistant ferrite material having a low carbon content and a chromium content of at least 13% and at most 17%, such as e.g. X2Cr13MoSi. What is used here for magnetic separating element 40 in this context is preferably a non-magnetic austenite material such as, for example, austenite 1.14944, Inconel IN 718, Udimet 630, or PH15-7, which produces an appreciable reduction in magnetic losses. The result is to make available a one-piece, economically manufacturable valve sleeve 4, including magnetic separating element 40, as a powder injection-molded component 41 having reduced magnetic losses as well as permanent corrosion resistance with respect to the fuel that is passed through passthrough opening 6 and is located on the inner periphery of valve sleeve 4.

Figure 3:
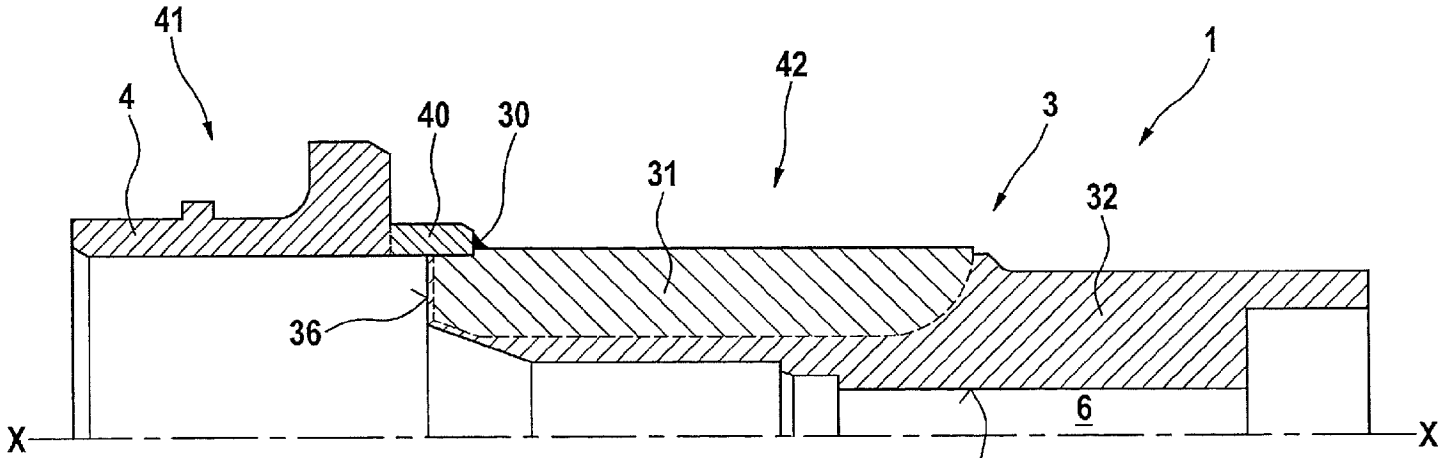
FIG. 3 is a sectioned depiction of the valve sleeve and of an internal pole, in accordance with a second exemplifying embodiment of the fuel injection valve of FIG. 1.

In contrast to the first exemplifying embodiment described above, internal pole 3 of the second exemplifying embodiment of FIG. 3 is embodied as a powder injection-molded component 42. Here internal pole 3 encompasses a first region 31 having a first magnetic saturation induction and a second region 32 having a second magnetic saturation induction that is lower than the first magnetic saturation induction. The first and second regions 31, 32 are intermaterially joined to one another. In order to achieve good magnetic efficiency, first region 31 is preferably manufactured from an FeSi material having a silicon proportion from 1% to 7%, or from an FeCo material having a cobalt proportion from 17% to 50%, which ensures high dynamics with short switching times for the fuel injection valve. Second region 32 is manufactured from fuel-resistant, high-pressure-resistant ferrite material having a low carbon proportion and a chromium content of 13% to 17%, which exhibits permanent robustness with regard to fuel coming into contact with it. Second region 32 furthermore forms an enveloping region 35 of passthrough opening 6 and an end-face region 36, and thereby protects first region 31, manufactured from a non-fuel-resistant material, from contact with fuel. End-face region 36 moreover functions as a wear-resistant stop for magnet armature 5. The material of second region 32 is furthermore substantially more economical than the material used for first region 31, resulting in an appreciable reduction in component costs.

Figure 4:
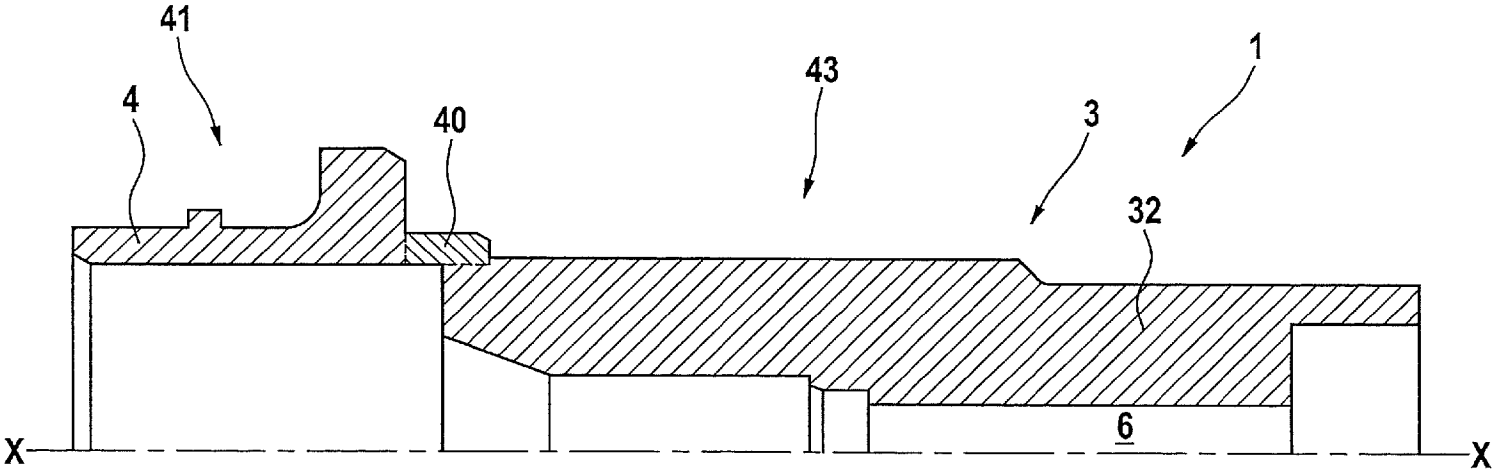
FIG. 4 is a sectioned depiction of the valve sleeve and of an internal pole, in accordance with a third exemplifying embodiment of the fuel injection valve of FIG. 1.

In contrast to the first and second exemplifying embodiments described above, in the third exemplifying embodiment depicted in FIG. 4, valve sleeve 4, magnetic separating element 40, and internal pole 3 are embodied in one piece as a powder injection-molded component 43, and are intermaterially joined to one another. Valve sleeve 4 and internal pole 3 that is constituted entirely from second region 32 are manufactured here from the same material, in particular from X2Cr13MoSi, which exhibits good fuel resistance. Alternatively, internal pole 3 can also be manufactured from a material having a high magnetic saturation induction, such as e.g. an FeCo material having a cobalt proportion from 48% to 50%, which also exhibits fuel resistance as well as the advantage of high magnetic saturation induction. For magnetic separating element 40, the same austenite material as in the first and second exemplifying embodiments is used.

Figure 5:
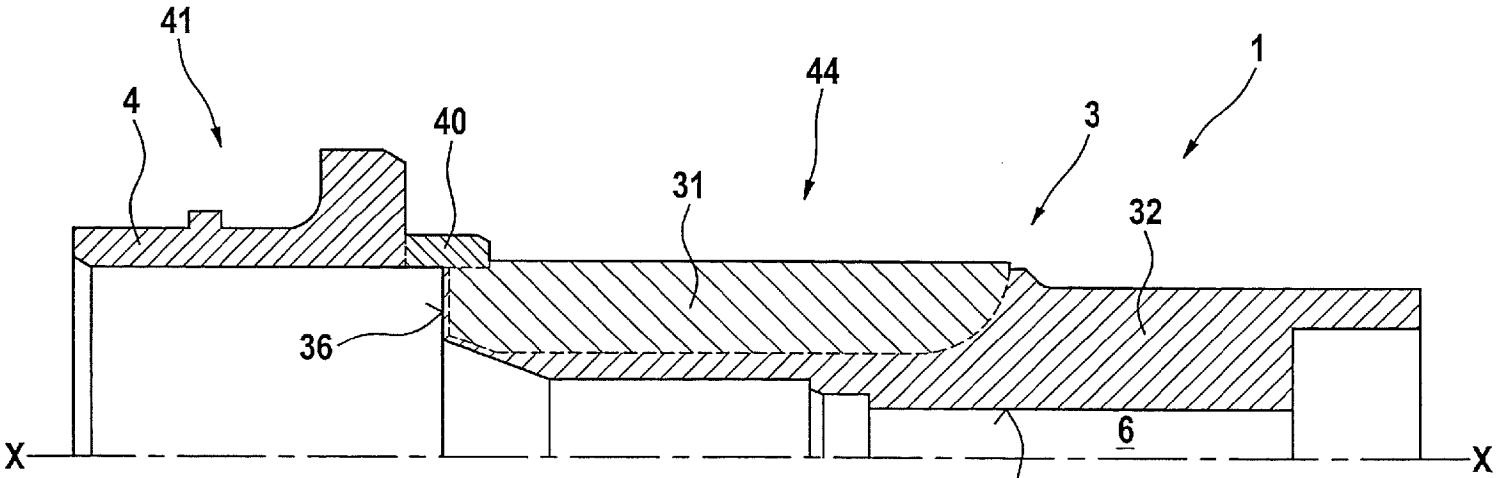
FIG. 5 is a sectioned depiction of the valve sleeve and of an internal pole, in accordance with a fourth exemplifying embodiment of the fuel injection valve of FIG. 1.

In the case of the fourth exemplifying embodiment depicted in FIG. 5, valve sleeve 4, magnetic separating element 40, and internal pole 3 are embodied in one piece as a powder injection-molded component 44 and are intermaterially joined to one another. Internal pole 3 is constructed here, in the same way as in the second exemplifying embodiment, from a first and a second region 31, 32, so that reference may be made to the description thereof above.

Figure 6:
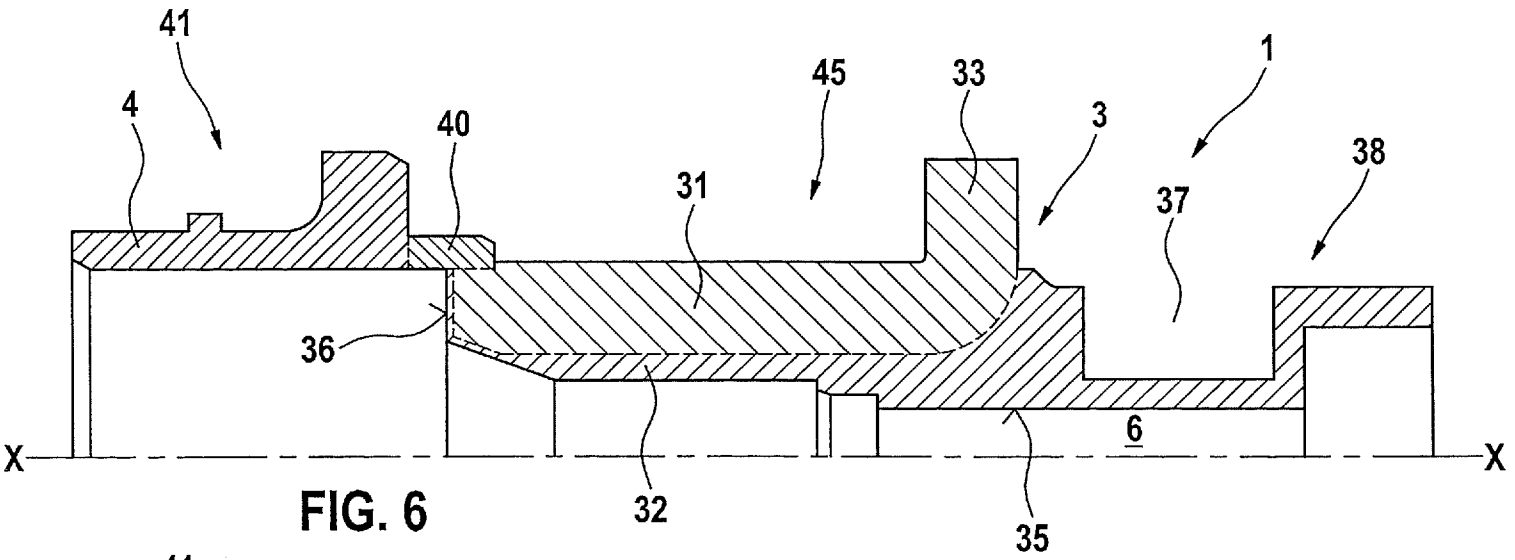
FIG. 6 is a sectioned depiction of the valve sleeve and of an internal pole, in accordance with a fifth exemplifying embodiment of the fuel injection valve of FIG. 1.

In the case of the fifth exemplifying embodiment depicted in FIG. 6, valve sleeve 4, magnetic separating element 40, and internal pole 3 are embodied in one piece as a powder injection-molded component 45 and are intermaterially joined to one another. In contrast to the fourth exemplifying embodiment described above, first region 31 of internal pole 3 has in this case a projecting circumferential flange region 33 that is integrated into the one-piece powder injection-molded component 45 as an upper cover of fuel injection valve 1. In addition, a recess 37 is provided in an end portion 38 of second region 32, thereby avoiding an unnecessary accumulation of material and appreciably simplifying the injection molding operation. In addition to a lower component weight, lower per-part costs are also achieved thereby.

Figure 7:
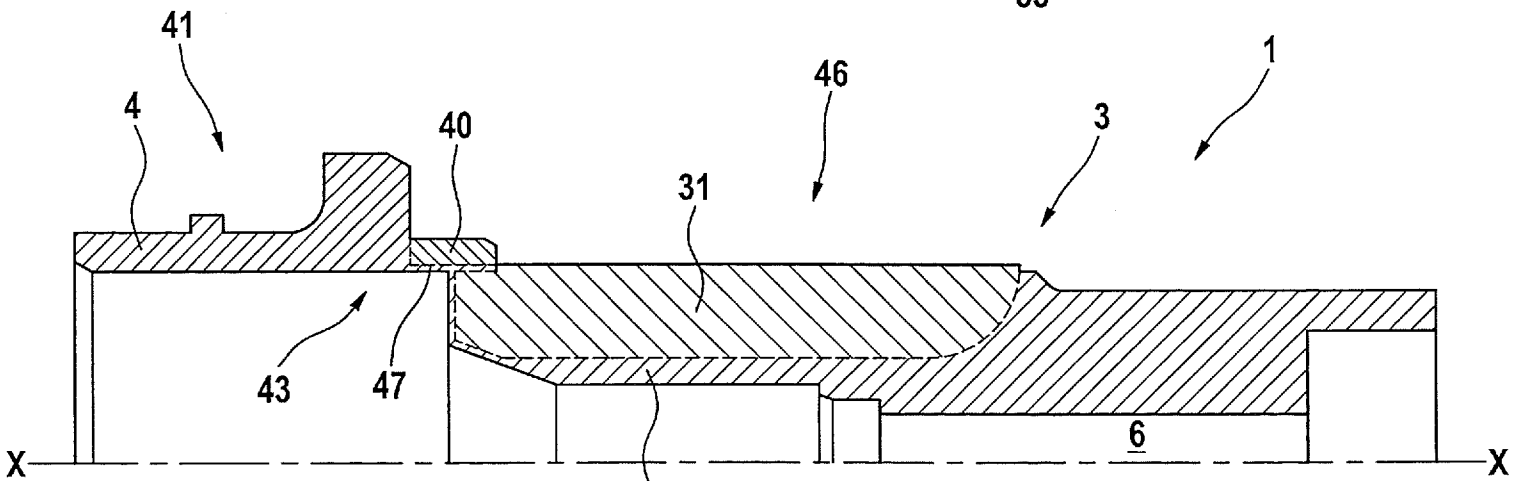
FIG. 7 is a sectioned depiction of the valve sleeve and of an internal pole, in accordance with a sixth exemplifying embodiment of the fuel injection valve of FIG. 1.

In the case of the sixth exemplifying embodiment depicted in FIG. 7, valve sleeve 4, magnetic separating element 40, and internal pole 3 are embodied in one piece as a powder injection-molded component 46 and are intermaterially joined to one another. In contrast to the fourth and fifth exemplifying embodiments described above, in the case of the sixth exemplifying embodiment depicted in FIG. 7 the fuel-resistant material used for valve sleeve 4 and for second region 32 of internal pole 3 is also provided on an inner enveloping region 47 of magnetic separating element 40. A completely continuous fuel-resistant protective layer is thereby achieved on the entire inner enveloping surface of passthrough opening 6 of powder injection-molded component 46.

Alternative configurations for magnetic separating element 40, which is embodied as a magnetic choke and is integrated into the one-piece powder injection-molded component, are described in detail below with reference to FIGS. 8 to 10. Identical or functionally identical components are labeled in the exemplifying embodiments with the same reference characters. Magnetic separating elements 40 described in FIGS. 8 to 10 can be used with all the previously described exemplifying embodiments.

Figure 8:
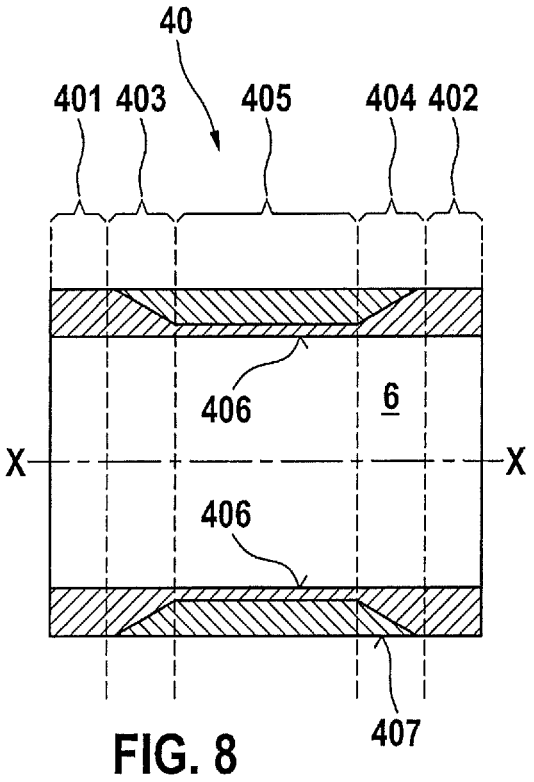
FIG. 8 is a sectioned depiction of a magnetic choke of the fuel injection valve according to the present invention.

As is evident from FIG. 8, magnetic separating element 40 of cylindrical annular configuration is embodied here as a magnetic choke having a first and a second magnetic connection region 401, 402, a choke region 405, and a first and a second transition region 403, 404. The first and second transition regions 403, 404 are disposed in an axial direction X-X between the first and the second connection region 401, 402, and choke region 405 is disposed between the first and the second transition region 403, 404.

As is further evident from FIG. 8, first and second transition regions 403, 404 are embodied in tapering fashion toward the respective connection region 401 and 402, and toward an outer enveloping surface 407 of magnetic separating element 40. In addition, choke region 405 has an inner cylindrical region 406 that is embodied as a thin ferritic layer. In order to increase strength, choke region 405 and parts of transition regions 403, 404 are filled with non-magnetic austenite material or ceramic. A preferred layer thickness of cylindrical region 406 here is a maximum of 0.5 mm, in particular 0.2 to 0.3 mm, particularly preferably 0.25 mm. Variation of the layer thickness makes possible individual adaptation or tuning of the choke effect of magnetic separating element 40.

Figure 9:
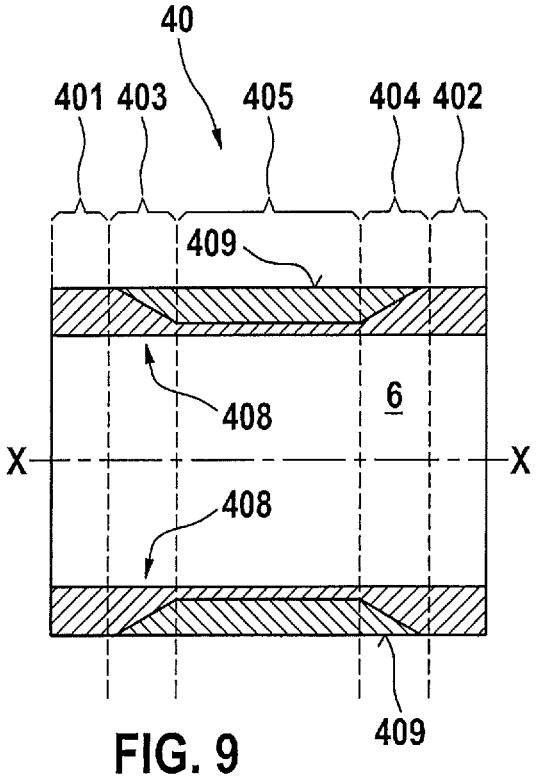
FIG. 9 is a sectioned depiction of a further magnetic choke of the fuel injection valve according to the present invention.

As compared with FIG. 8, magnetic separating element 40 depicted in FIG. 9 has a choke region 405 embodied inversely in the radial direction, said region tapering in the respective transition regions 403 and 404 toward an inner enveloping surface 408 of magnetic separating element 40. As a result, magnetic separating element 40 of the second exemplifying embodiment has an outer cylindrical region 409 made of magnetic, electrically conductive material. In order to achieve sufficient fuel resistance with respect to fuel being passed through passthrough opening 6, instead of the austenite material a non-magnetic, preferably also eddy-current-free ceramic material can alternatively be used here for filling in choke region 405 and in parts of transition regions 403, 404.

Figure 10:
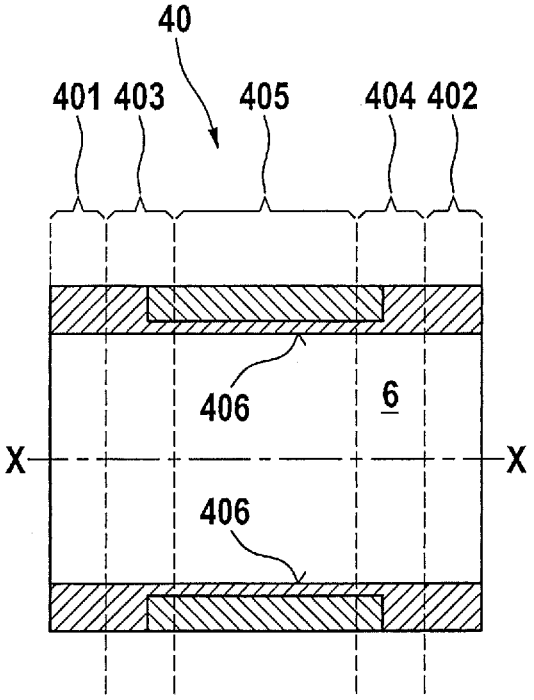
FIG. 10 is a sectioned depiction of a further magnetic choke of the fuel injection valve according to the present invention.

In the case of magnetic separating element 40 depicted in FIG. 10, transition regions 403, 404 are not embodied in tapering fashion in axial direction X-X. A choke effect necessary for the particular application instance can thus be adapted in targeted fashion by way of different conformations and proportions of magnetic and non-magnetic material, and/or by their distribution in axial direction X-X of magnetic separating element 40.

As shown in all the exemplifying embodiments, one-piece powder injection-molded components for the fuel injection valve according to the present invention can thus be produced particularly economically in a single production process, which is not achievable with conventional production methods. In addition to a cost efficiency that is thereby appreciably improved, what is achieved here in particular is an appreciable reduction in magnetic losses, with the result that the dynamic behavior desired and necessary in high-pressure injection valves is substantially improved, and their switching time is perceptibly shortened. By way of a suitable combination of the physical construction described in the above exemplifying embodiments, and of the materials used, an increase in magnetic force in the range from 25% to 35% is achievable.

What is claimed is:

1. A fuel injection valve for injecting fuel, comprising:

a coil;

an internal pole;

a valve sleeve; and a magnetic separating element;

wherein (i) the valve sleeve and the magnetic separating element are configured in one piece as a powder injection-molded component, (ii) the valve sleeve forms a magnetic region, (iii) the magnetic separating element forms a non-magnetic region, and (iv) the valve sleeve and the magnetic separating element are intermaterially joined to one another;

wherein a welded join or soldered join is provided between the powder injection-molded component and the internal pole;

wherein the internal pole has a pass-through opening in an axial direction; and wherein the internal pole is (i) configured as a powder injection-molded component and (ii) made of a material having a high magnetic saturation induction, including FeCo having a cobalt proportion from 17% to 50%.

2. The fuel injection valve as recited in claim 1, wherein the internal pole (i) is configured as a powder injection-molded component and (ii) has a first region having a first magnetic saturation induction and a second region having a second magnetic saturation induction lower than the first magnetic saturation induction, the first region and the second region being intermaterially joined to one another.

3. A fuel injection valve for injecting fuel, comprising:

a coil;

an internal pole;

a valve sleeve; and a magnetic separating element;

wherein (i) the valve sleeve and the magnetic separating element are configured in one piece as a powder injection-molded component, (ii) the valve sleeve forms a magnetic region, (iii) the magnetic separating element forms a non-magnetic region, and (iv) the valve sleeve and the magnetic separating element are intermaterially joined to one another;

wherein a welded join or soldered join is provided between the powder injection-molded component and the internal pole;

wherein the internal pole has a pass-through opening in an axial direction;

wherein the valve sleeve, the magnetic separating element, and the internal pole are (i) configured in one piece as a powder injection-molded component, and (ii) intermaterially joined to one another; and wherein the valve sleeve and the internal pole are both made of X2Cr13MoSi.

4. The fuel injection valve as recited in claim 3, wherein the second region of the internal pole is made of a fuel-resistant magnet material.

5. A fuel injection valve for injecting fuel, comprising:

a coil;

an internal pole;

a valve sleeve; and a magnetic separating element;

wherein (i) the valve sleeve and the magnetic separating element are configured in one piece as a powder injection-molded component, (ii) the valve sleeve forms a magnetic region, (iii) the magnetic separating element forms a non-magnetic region, and (iv) the valve sleeve and the magnetic separating element are intermaterially joined to one another;

wherein a welded join or soldered join is provided between the powder injection-molded component and the internal pole;

wherein the internal pole has a pass-through opening in an axial direction;

wherein the valve sleeve, the magnetic separating element, and the internal pole are (i) configured in one piece as a powder injection-molded component, and (ii) intermaterially joined to one another;

wherein the second region of the internal pole is made of a fuel-resistant magnet material; and wherein the second region of the internal pole forms an enveloping region of the pass-through opening and an end-face region of the internal pole, the end-face region having a thickness of 0.5 mm in the axial direction.

6. The fuel injection valve as recited in claim 5, wherein the end-face region forms a stop for a magnet armature.

7. The fuel injection valve as recited in claim 4, wherein the first region of the internal pole has a circumferential flange region projecting in a radial direction.

8. The fuel injection valve as recited in claim 7, wherein the magnetic separating element is a circumferential ring.

9. The fuel injection valve as recited in claim 8, wherein a fuel-resistant material is provided on an inner enveloping region of the annular magnetic separating element.

10. The fuel injection valve as recited in claim 8, wherein the magnetic separating element is configured as a magnetic choke having a first magnetic connection region, a second magnetic connection region, a choke region, a first transition region, and a second transition region, and wherein the first transition region and the second transition region are disposed in an axial direction between the first connection region and the second connection region, and wherein the choke region is disposed between the first transition region and the second transition region.

11. The fuel injection valve as recited in claim 10, wherein the first transition region and the second transition region are configured in tapering fashion.

12. The fuel injection valve as recited in claim 10, wherein the choke region has at least one of an inner cylindrical region and an outer cylindrical region made of a magnetic, electrically conductive material.

13. The fuel injection valve as recited in claim 10, wherein the choke region is made of an electrically non-conductive material.

* * * * *